US010880653B2

(12) United States Patent
Ilkorur et al.

(10) Patent No.: US 10,880,653 B2
(45) Date of Patent: Dec. 29, 2020

(54) FLAT TRANSDUCER FOR SURFACE ACTUATION

(71) Applicant: Apple Inc., Cupertino, CA (US)

(72) Inventors: Onur I Ilkorur, Campbell, CA (US); Michael J Newman, Cupertino, CA (US); Bonnie W Tom, San Leandro, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/418,745

(22) Filed: May 21, 2019

(65) Prior Publication Data

US 2020/0374633 A1 Nov. 26, 2020

(51) Int. Cl.

| | |
|---|---|
| ***H04R 11/02*** | (2006.01) |
| ***H04R 9/02*** | (2006.01) |
| ***H04R 9/06*** | (2006.01) |
| ***H04R 9/04*** | (2006.01) |
| ***G10K 9/13*** | (2006.01) |

(52) U.S. Cl.

CPC ..... *H04R 11/02* (2013.01); *G10K 9/13* (2013.01); *H04R 9/025* (2013.01); *H04R 9/046* (2013.01); *H04R 9/06* (2013.01)

(58) Field of Classification Search

CPC ..... H04R 9/025; H04R 9/046; H04R 9/06; H04R 11/02; H04R 2400/03

USPC ..... 381/152, 400, 403, 417, 423, 431

See application file for complete search history.

(56) References Cited

U.S. PATENT DOCUMENTS

| | | | | |
|---|---|---|---|---|
| 4,107,479 | A | 8/1978 | Heil | |
| 6,487,300 | B1 * | 11/2002 | Lee | B06B 1/045 340/407.1 |
| 6,850,138 | B1 | 2/2005 | Saki | |
| 8,398,570 | B2 | 3/2013 | Mortimer et al. | |
| 8,682,022 | B2 | 3/2014 | Cobb | |
| 9,271,085 | B2 | 2/2016 | Kim | |
| 2002/0061115 | A1 * | 5/2002 | Chung | H04R 9/06 381/398 |
| 2008/0279406 | A1 | 11/2008 | D'Hoogh | |
| 2012/0033849 | A1 * | 2/2012 | Kang | H04R 11/02 381/412 |
| 2014/0270276 | A1 * | 9/2014 | Iwakura | H04R 1/00 381/190 |
| 2016/0021452 | A1 * | 1/2016 | Tang | H04R 9/025 381/151 |
| 2017/0371172 | A1 | 12/2017 | Keane et al. | |
| 2018/0255401 | A1 * | 9/2018 | Asfaw | H04R 1/028 |
| 2019/0091725 | A1 * | 3/2019 | Okayasu | F16F 9/53 |

FOREIGN PATENT DOCUMENTS

CN 208141028 U 11/2018

* cited by examiner

*Primary Examiner* — Jesse A Elbin

(74) *Attorney, Agent, or Firm* — Womble Bond Dickinson (US) LLP

(57) ABSTRACT

A transducer assembly including a stiffener plate having a first side and a second side; a voice coil coupled to the second side of the stiffener plate; a magnet assembly positioned along the second side of the stiffener, the magnet assembly operable to produce a magnetic field that causes a movement of the magnet assembly relative to the voice coil; and a spring suspending the magnet assembly from the stiffener plate such that the movement of the magnet assembly drives a movement of the stiffener plate.

20 Claims, 8 Drawing Sheets

FLAT TRANSDUCER FOR SURFACE ACTUATION

FIELD

An aspect of the invention is directed to flat transducer for surface actuation, more specifically, a flat transducer having a suspension system incorporated within the magnet assembly to reduce an overall thickness. Other aspects are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakers that can benefit from improved audio performance. Smart phones, however, do not have sufficient space to house transducers, or other actuators, having a relatively large z-height or thickness. This is also true for some portable personal computers such as laptop, notebook, and tablet computers, and, to a lesser extent, desktop personal computers with built-in transducers. Such size constraints, however, can pose a challenge since the transducers or actuators incorporated within these devices may include a moving coil motor made up of a stack-up of various components. For example, the moving coil motor may include a diaphragm, voice coil and magnet assembly positioned within a frame, all of which add to the overall z-height of the assembly.

SUMMARY

An aspect of the disclosure is directed to a thin transducer that serves as an actuator for the surface to which it is connected to. Such a transducer may also be referred to herein as an electro-dynamic transducer or a shaker. A shaker (or surface actuator) may be used to actuate (e.g., vibrates) a surface it is connected to and use the structure as its radiating surface. Shakers may depend on the inertia of the magnet motor system for their performance. The higher the inertia and the force, which is generated by the magnet motor, the more effective they become in application. Given different working orientations, heavy magnet mass, however, develops a static load over the suspension due to gravity or acceleration of the device and may force the suspension to bend in an axis other than parallel to the symmetry axis of the transducer. Any suspension should constrain the movement of the magnet motor, only in the symmetry axis direction, and should not allow relative motion to occur between any of two points over the magnet. To accomplish this, a suspension having a high stiffness to prevent the magnet motor from moving in directions other than parallel to the symmetry axis may be used. Such suspensions, however, are positioned in the excursion space between the moving mass (e.g., magnet) and the actuating surface, which can increase non-linear behavior of the suspension since it must collapse completely to allow maximum excursion. In addition, rigid suspension members result in high resonance frequencies for a given mass, which can adversely affect the performance of the assembly.

The transducer assembly disclosed herein solves some of the previously discussed challenges by incorporating the suspension assembly inside the magnet assembly stack-up, and in such a way that it does not increase the z-height of the overall assembly. For example, the suspension assembly may include a number of suspension elements or members, such as springs (e.g., leaf springs) arranged around the perimeter of the magnet assembly, as opposed to extending from a top or bottom side of the magnet assembly, so that they do not add to the z-height. In addition to a reduced z-height, rocking mode prevention may be achieved by adding suspension elements (e.g., leaf springs) to a center opening of the magnet assembly. The suspension elements in the center opening may be oriented at an approximately 90 (±15) degree angle to the diagonals of the magnet assembly. One advantage to rotating the inner suspension elements relative to the outer suspension elements as described is an increased stiffness of the suspension system in the plane which is parallel to the radiating surface. In addition, the suspension elements may have a width dimension which also helps with rocking mode prevention. For example, the suspension elements may have a width dimension that covers up to $1/12^{th}$ of the side of the magnet assembly to which it is attached. In addition, the proposed suspension assembly enables the magnet motor assembly thickness to be used by the suspension assembly, giving more room for the suspension geometry. Still further, the suspension assembly disclosed herein does not have to collapse completely to allow the maximum excursion of the magnet motor assembly. This, in turn, improves the linear operation range of the suspension assembly. Moreover, the suspension member (e.g., spring) can be made larger than the excursion space (e.g. greater z-height), enabling the suspension to be more flexible and reach a lower resonance frequency with the moving mass (e.g., magnet assembly) for a given fixed thickness. In addition, in the case of a leaf spring suspension member, the leaf spring provides high rigidity within the parallel surface to the radiating surface, and protects the voice coil from getting into contact with metal components of the magnet. In addition, the combined two suspension system may provide additional advantages, including but not limited to, minimizing bending of the magnet assembly when the device is held in a vertical orientation, and may be effective towards high acceleration values which can be caused by drop.

More specifically, aspects of the disclosure include a transducer assembly having a stiffener plate with a first side and a second side, and a voice coil coupled to the second side of the stiffener plate. A magnet assembly is positioned along the second side of the stiffener, the magnet assembly operable to produce a magnetic field that causes a movement of the magnet assembly relative to the voice coil. In addition, a spring suspends the magnet assembly from the stiffener plate such that the movement of the magnet assembly drives a movement of the stiffener plate. The spring may be arranged around a perimeter of the magnet assembly and include a first extension member attached to the second side of the stiffener plate and a second extension member attached to a bottom side of the magnet assembly, which faces away from second side of the stiffener plate. The magnet assembly may include a polygon shape having a number of sides, and the spring is positioned along one of the sides. The spring may be one of a plurality of springs symmetrically arranged around a perimeter of the magnet assembly. For example, the spring may be a first spring, the assembly may further include a second spring, and the first leaf spring is positioned around a perimeter of the magnet assembly and the second spring is positioned within a center opening of the magnet assembly. The second spring may be arranged at any angle relative to the first leaf spring. In addition, an actuating surface may be coupled to the first side of the stiffener plate. The actuating surface may include a wall of a device within which the transducer assembly is integrated.

In another aspect, a transducer assembly is provided including a driven member having a first side and a second side, a voice coil coupled to the second side of the driven member, a magnet assembly positioned along the second side of the driven member, the magnet assembly operable to produce a magnetic field that causes a movement of the magnet assembly relative to the voice coil, and a plurality of springs coupling the magnet assembly to the driven member to drive a movement of the driven member. The driven member may be any structure that can be caused to move by the magnet assembly. For example, the driven member may be a stiffener plate attached to an actuating surface (e.g., a wall of an enclosure), or the driven member could be the actuating surface such that a stiffener plate is omitted. In some aspects, each spring of the plurality of springs may include a first extension member attached to the second side of the driven member and a second extension member attached to a bottom side of the magnet assembly. The plurality of springs may be symmetrically arranged around the magnet assembly. The plurality of springs may include a first set of springs and a second set of springs. The first set of springs may be arranged around a perimeter of the magnet assembly, and the second set of springs may be arranged around a center opening of the magnet assembly. The perimeter of the magnet assembly may be defined by sides of the magnet assembly connected to form a polygon shape and the second set of springs are positioned along each diagonal axis of the polygon shape. In addition, the center opening of the magnet assembly may include a polygon shape. Each spring of the second set of springs may be oriented 90 degrees+/−15 degrees with respect to the diagonal axes of the magnet assembly perimeter. In some aspects, the bottom side of the magnet assembly may include a bottom recessed region within which the second extension member is positioned, and a top side of the magnet assembly comprises a top recessed region aligned with the first extension member.

In still further aspects, a transducer assembly is provided including a stiffener plate having a first side operable to be connected to an actuating surface and a second side, a voice coil coupled to the second side of the stiffener plate, a magnet assembly positioned along the second side of the stiffener plate, the magnet assembly operable to produce a magnetic field that causes a movement of the magnet assembly relative to the voice coil, and a plurality of suspension members coupling the magnet assembly to the stiffener plate and the movement of the magnet assembly drives a movement of the stiffener plate, wherein the plurality of suspension members are symmetrically arranged around the magnet assembly. The plurality of suspension members may include leaf springs having a first end coupled to the second side of the stiffener plate and a second end coupled to a bottom side of the magnet assembly. The plurality of suspension members may be equally arranged around a perimeter of the magnet assembly and a center opening of the magnet assembly. In some cases, at least one of the plurality of suspension members may be arranged around the center opening is rotated at least 15 degrees relative to at least one of the plurality of suspension members arranged around the perimeter. In some aspects, the first side of the stiffener plate is connected to the actuating surface, and the movement of the stiffener plate causes a vibration of the actuating surface. In an additional aspect, the transducer may be constructed without a stiffener plate and the suspension and voice coil may be coupled directly to the actuating surface.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
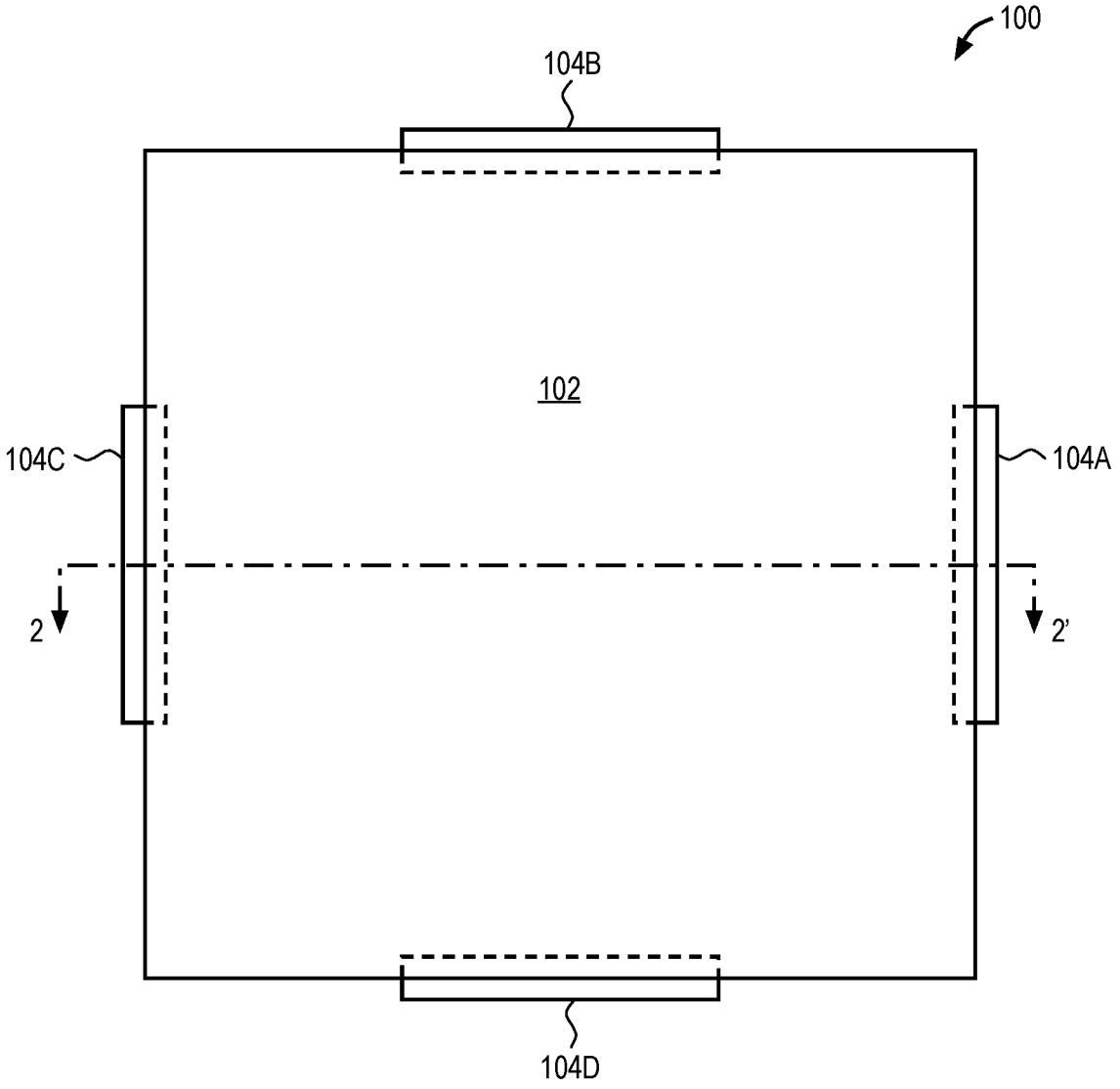
FIG. 1 illustrates a top plan view of one aspect of a transducer assembly.

FIG. 1 illustrates a top plan view of an aspect of a transducer assembly. Transducer assembly 100 may be, for example, an electrodynamic or electro-acoustic transducer that converts electrical signals into vibrations and/or audible signals that can be output from a device within which transducer assembly 100 is integrated. For example, transducer assembly 100 may be a shaker integrated within a smart phone, or other similar compact electronic device, and which is attached to a surface of the device to actuate (e.g., vibrate) the surface. Transducer assembly 100 may be enclosed within a housing or enclosure of the device within which it is integrated.

Transducer assembly 100 may include a driven member 102 that is coupled to a magnet assembly (not shown) by a number of suspension members 104A, 104B, 104C and 104D. The driven member 102 may be any type of structure that can be attached to another structure or surface that is to be actuated (e.g., a wall of the enclosure) to drive an actuation (e.g., vibration) of the structure or surface to be actuated, or may be the actuating surface itself. For example, in one aspect, driven member 102 may be a stiffener plate that is attached to an actuating surface (e.g., the structure to be actuated). The driven member 102 may therefore also be referred to herein interchangeably as a stiffener plate. The stiffener plate 102 may be a planar structure having a polygon shape defined by multiple sides, as shown. For example, the stiffener plate 102 can have a square shape, a rectangular shape, a triangular shape, or the like. The suspension members 104A-104D may, in turn, be arranged around the perimeter of the plate 102. For example, there may be one suspension member 104A-104D arranged along each sided of the plate 102. The suspension members 104A-104D may be evenly spaced around plate, or symmetrically arranged around plate 102, as shown.

The suspension members 104A-104D may be any type of suspension member suitable for movably coupling the stiffener plate 102 to the magnet assembly. In addition, the suspension members 104A-104D may have a thin profile (e.g. z-height), or otherwise be configured, so that it does not increase the z-height of the overall assembly. For example, suspension members 104A-104D may be of a size and shape that can be arranged around the perimeter of the stiffener plate 102 and the magnet assembly, as opposed to between the stiffener plate 102 and the magnet assembly. Still further, suspension members 104A-104D may have any size and shape sufficient to prevent a translation, or other motion of the associated magnet assembly, that is not parallel to the symmetry axis direction (e.g., vibration axis), relative to the stiffener plate 102. Representatively, suspension members 104A-104D may be resilient structures, including but not limited to, springs, leaf springs, or the like having at least one angle or joint, as will be described further in reference to FIGS. 3-4.

Figure 2:
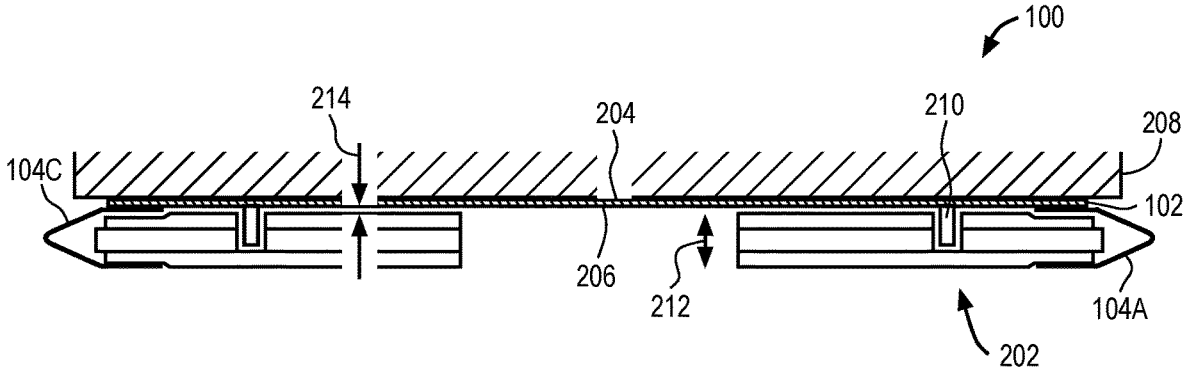
FIG. 2 illustrates a cross-sectional side view of one aspect of a transducer assembly of FIG. 1 along line 2-2'.

FIG. 2 illustrates a cross-sectional side view of the transducer assembly of FIG. 1 along line 2-2'. From this view, it can be seen that transducer assembly 100 has a relatively flat profile, or reduced z-height. In this aspect stiffener plate 102 is a substantially planar structure having a top side 204 and a bottom side 206. The top side 204 of stiffener plate 102 may be attached to an actuating surface, structure or member 208, which the transducer assembly 100 is used to actuate (e.g., vibrate). Voice coil 210 is attached to, or suspended from, the bottom side 206 of stiffener plate 102. The magnet assembly 202 is further suspended from the bottom side 206 of stiffener plate 102 by suspension members 104A, 104C. It is further understood that although a stiffener plate 102 and actuating surface 208 are described, stiffener plate 102 may be omitted and voice coil 210 and suspension members 104A, 104C may be attached directly to actuating surface 208.

As previously discussed, the suspension members 104A, 104C (as well as 104B, 104C although not shown) are relatively low profile structures which extend outwardly, around a perimeter of the magnet assembly 202, as opposed to extending above the magnet assembly 202. For example, suspension members 104A, 104C may be continuous, integrally formed structures that have one end attached to a bottom side of the stiffener plate 102, a resilient portion that wraps around the side of magnet assembly 202, and another end attached to the bottom side of magnet assembly 202. Suspension members 104A, 104C therefore allow the magnet assembly 202 to move relative to stiffener plate 102, as illustrated by arrow 212, without occupying the excursion space 214 between plate 102 and magnet assembly 202, or adding to the z-height of the overall assembly. In addition, it should be understood that while the suspension members (e.g., members 104A-104D) are described as being attached to the stiffener plate 102, in some aspects, the stiffener plate and suspension members may be manufactured as one integrally formed structure such that the suspension members and stiffener plate are a single piece. Alternately, as previously discussed, the stiffener plate 102 may be omitted from the transducer assembly and the suspension members 104A-104D may be attached to the actuating surface 208.

Figure 3:
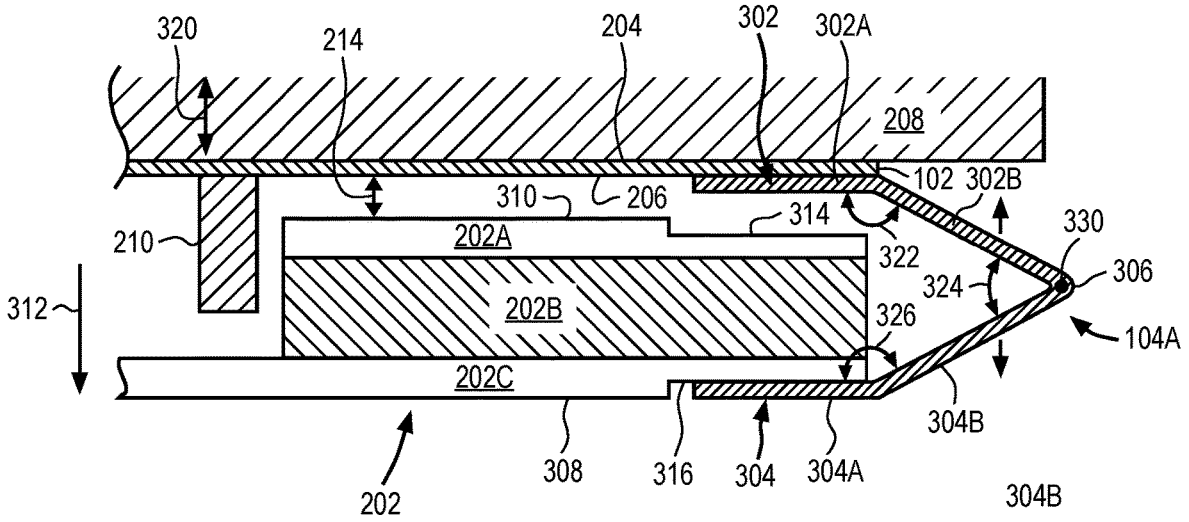
FIG. 3 illustrates a magnified cross-sectional side view of an aspect of the transducer assembly of FIG. 1.
Figure 4:
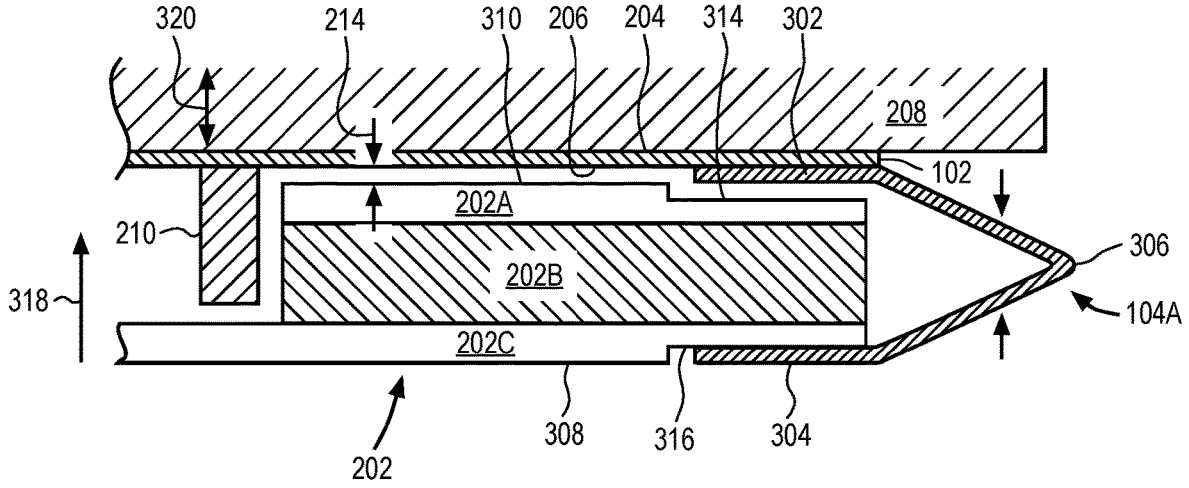
FIG. 4 illustrates a magnified cross-sectional side view of another aspect of the transducer assembly of FIG. 1

Representatively, it can be seen from FIGS. 3-4, which are magnified views of the assembly end having suspension member 104A, suspension member 104A includes a top arm 302 and a bottom arm 304 that are connected together by a resilient portion, hinge or joint 306. The top arm 302, bottom arm 304 and resilient portion or joint 306 may be a single, integrally formed structure, for example, formed from a single sheet of material (e.g., metal) or formed from a composite/multi-material laminate (e.g. flex material). The material of suspension member 104A may be a different material than that which is used to form the stiffener plate 102 and/or actuating surface 208 to which it is attached, or the same material. A first portion 302A of the top arm 302 runs parallel to stiffener plate 102 and is attached along its top surface to the bottom side 206 of stiffener plate 102. Similarly, a first portion 304A of the bottom arm 304 runs parallel to stiffener plate 102 and is attached along its top surface to a bottom side 308 of magnet assembly 202. Each of the top arm and bottom arm 302, 304 further include second portions 302B, 304B that are at an angle 322, 326 to the first portions 302A, 304B, respectively, and extend toward one another to form a third angle 326 at joint 306. In this aspect, a cross-section of the suspension member 104A may be considered to have a triangular shape. It should be understood that this triangular shape is important to maintaining a parallel alignment between the stiffener plate 102 and/or actuating surface 208 and the magnet assembly 202 and preventing rotation and/or tilting of the magnet assembly 202 during excursion. In particular, during an expansion or contraction of the suspension member 104A, a hinge, rotational or pivot type movement about a rotation or pivot point or axis 330 at joint 306 allows second portions 302B, 304B to move relative to one another, and as they move, joint 306 translates within a horizontal plane parallel to the first portions 302A, 304A (as opposed to a vertical plane). The translation of joint 306 in this manner helps to maintain a parallel alignment between first portions 302A, 302B, and in turn, stiffener plate 102 and magnet assembly 202. Joint 306 will therefore be resilient or compliant enough to allow arms 302, 304 to move toward or away from one another, and in turn, allow magnet assembly 202 to move toward or away from stiffener plate 102 to actuate surface 208, however, stiff enough to maintain the previously discussed parallel alignment.

In some cases, recessed regions 314, 316 may be formed in the top side 310 and the bottom side 308 of magnet assembly 202, respectively, to accommodate the top and bottom arms 302, 304, respectively. For example, recessed region 314 may be formed in top side 310 of the top plate 202A of magnet assembly 202, to maximize the excursion space 214 between top plate 202A and stiffener plate 102. In addition, recessed region 316 may be formed in the bottom side 308 of bottom plate 202C, and bottom arm 304 may be positioned within the recessed region 316 so that bottom arm 304 is planar with bottom side 308 or otherwise does not extend below bottom side 308.

To drive such a movement, magnet assembly 202 may include a permanent magnet 202B positioned between top plate 202A and bottom plate 202C, which together form a mass that is movably suspended from stiffener plate 102 having voice coil 210 attached thereto. Magnet assembly 202 is suspended from stiffener plate 102 by suspension member 104A, as previously discussed, but is not otherwise coupled to any other structure along its bottom side 308. Magnet assembly 202 is therefore free to move up and down (e.g., in a direction of arrows 312, 314) and relative to stiffener plate 102. In this aspect, when a current is applied to voice coil 210 (e.g. through a voice coil wire connected to circuitry), magnet assembly 202 produces a magnetic field that causes the voice coil 210 and magnet assembly 202 to move relative to one another. For example, the magnetic field may create a repelling force causing the voice coil 210 and magnet assembly 202 to want to move away from one another. For example, voice coil 210 wants to move in an upward direction and magnet assembly 202 wants to move in a downward direction. Voice coil 210, however, is attached to stiffener plate 102 and actuating surface 208, which may be more resistant to movement than magnet assembly 202. For example, the stiffener plate 102 may be glued to an actuating surface 208 that is a surface or wall of a device enclosure within which the assembly 100 is integrated. Magnet assembly 202 therefore begins to move and this movement of magnet assembly 202, ultimately causes a movement or vibration of the stiffener plate 102, and actuates (e.g., vibrates) the actuating surface 208 coupled thereto. Changing or discontinuing the current applied to the voice coil 210 may change the direction in which the voice coil 210 and/or magnet assembly 202 want to move relative to one another.

FIG. 3 shows suspension member 104A expanding (e.g., arms 302, 304 moving away from one another) and magnet assembly 202 moving away from stiffener plate 102 (e.g., in a direction of arrow 312). FIG. 4 shows suspension member 104B contracting (e.g., arms 302, 304 moving toward one another) and magnet assembly 202 moving toward stiffener plate 102 (e.g., in a direction of arrow 314). The movement of magnet assembly 202 relative to stiffener plate 102 and voice coil 208 as shown, actuates (e.g., vibrates) the actuating surface 206 causing it to move as illustrated by arrow 320. In addition, as can be seen from FIG. 4, recessed region 314 formed in the top side 310 of top plate 202A helps to maximize the excursion space 214 between to plate 202A and stiffener plate 102 so that magnet assembly 202 does not contact stiffener plate 102. In addition, as can be seen from FIG. 3-FIG. 4, the resilient joint 306 of suspension member 104A is arranged around a perimeter of magnet assembly 202 such that any expansion or contraction of suspension member 104A in a z-height direction does not add to a z-height of the overall assembly or otherwise occupy the excursion space 214.

Figure 5:
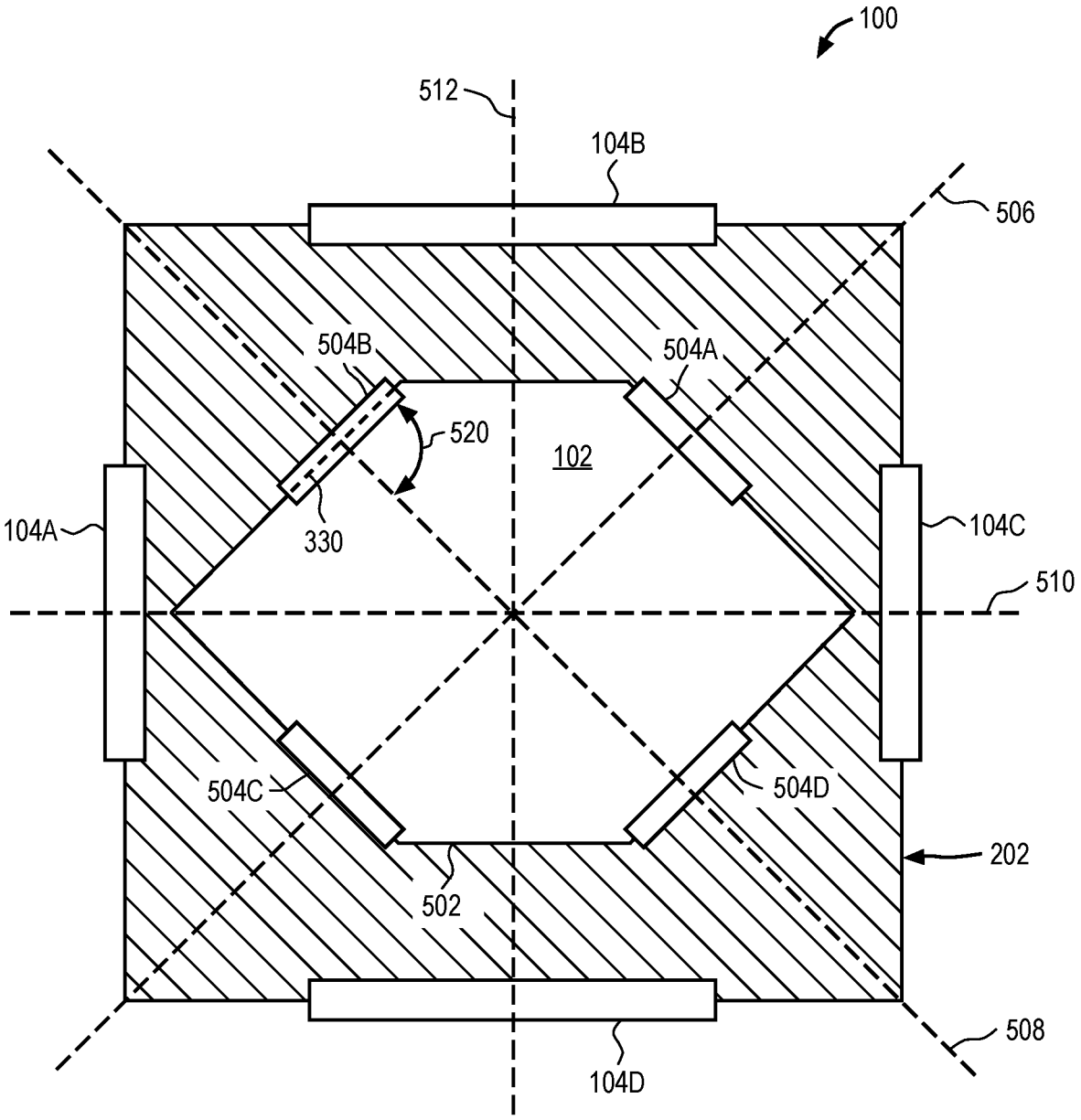
FIG. 5 illustrates a bottom plan view of one aspect of the transducer assembly of FIG. 1.

FIG. 5 illustrates a bottom plan view of the transducer assembly of FIG. 1. From this view, it can be seen that the bottom plate 202C of magnet assembly 202 may include opening 502 which extends through the entire magnet assembly (as shown in FIG. 2). Opening 502 may be used to accommodate additional suspension members 504A, 504B, 504C, 504D for attaching magnet assembly 202 to stiffener plate 102. Suspension members 504A-504D may be substantially similar to suspension members 104A-104D, and configured to suspend magnet assembly 202 from stiffener plate 102 in a similar manner, and without adding to a z-height of the assembly. In addition to suspending magnet 202 from stiffener plate 102, suspension members 504A-504D may be arranged around opening 502 to provide additional stability and reduce rocking. Representatively, suspension members 504A-504D may be arranged around opening 502 so that at least one of suspension members 504A-504D is between each of suspension members 104A-104D. In addition, suspension members 504A-504D may be rotated approximately 90 (+15) degrees as shown by angle 520, for example, from 75 degrees to 105 degrees, with respect to the diagonal axes 506, 508 of the magnet assembly 202. This 90 (+/−15) degree rotation may be defined by the rotation or pivot axis 330 of suspension member 504A-504D relative to the diagonal axes. For example, as illustrated in FIG. 5, suspension members 104A-104D may be arranged along each of the lateral and longitudinal axes 510, 512 of assembly 202. Suspension members 504A-504D may be arranged along each of the diagonal axes 506, 508 of the magnet assembly 202. Positioning outer suspension members 104A-104D at each side defining the perimeter of assembly 202, and inner suspension members 504A-504D at each of the diagonal axes 506, 508 of assembly 202 so that they are rotated relative to one another helps to reduce rocking of magnet assembly 202.

Opening 502 may have any shape suitable for accommodating this arrangement. For example, opening 502 may be any shape having sides along each diagonal axis of the magnet assembly 202 and to which suspension members 504A-504D may be attached. For example, in the illustrated configuration, magnet assembly 202 has a substantially square shape defined by four sides, and therefore two diagonal axes 506, 508. Opening 502 may therefore have a hexagon shape defined by six sides, and at least three diagonals, so that at least three sides for attaching the suspension members 504A-504D are aligned with each of the diagonal axes 506, 508, etc. Other opening 502 and magnet assembly 202 shapes are contemplated.

Figure 6:
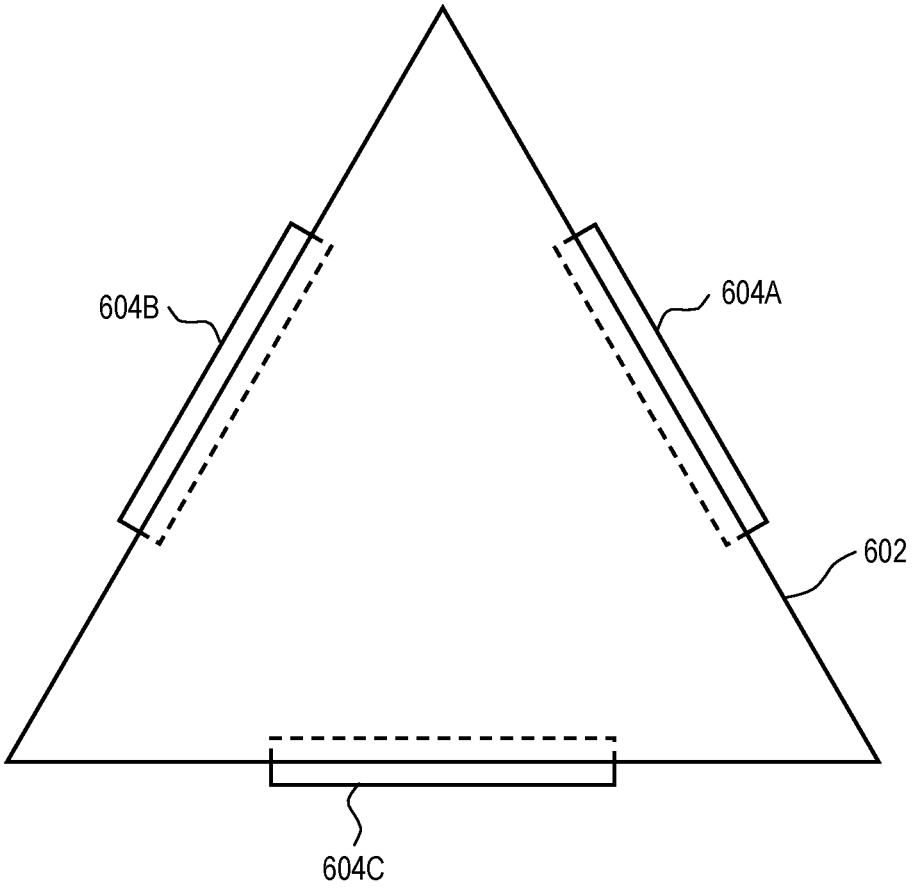
FIG. 6 illustrates a top plan view of one aspect of a transducer assembly.
Figure 7:
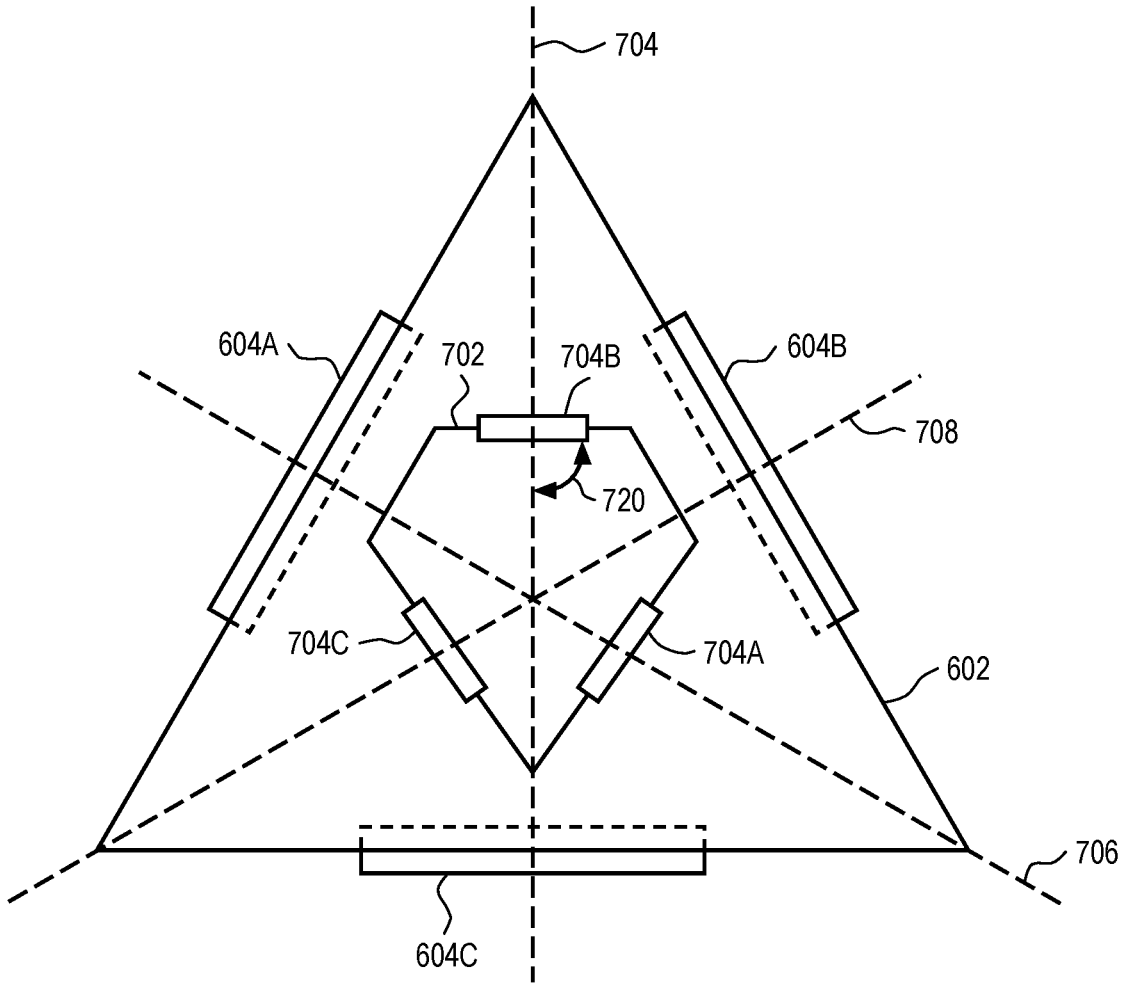
FIG. 7 illustrates a bottom plan view of one aspect of the transducer assembly of FIG. 6.

For example, FIG. 6 illustrates a top plan view of transducer assembly 602 having a triangular shape defined by three sides, and a suspension member 604A, 604B, 604C arranged along each side. As can be seen from the bottom plan view of transducer assembly 602 illustrated in FIG. 7, the corresponding magnet opening 702 may have a pentagon shape defined by five sides. At least one side of opening 702 is positioned along each of diagonal axes 704, 706, 708. Therefore when the suspension members 704A, 704B, 704C are positioned at a side of opening 702 along each of diagonal axes 704, 706, 708 at least one of suspension members 704A-704C is between each of suspension members 604A-604C, and rotated 90 (+/−15) degrees relative to the diagonal axes 704, 706, 708, as shown by angle 720, to reduce rocking. Said another way, each of suspension members 704A-704C are arranged perpendicular to the respective axis 704, 706, 708 passing through them.

Figure 8:
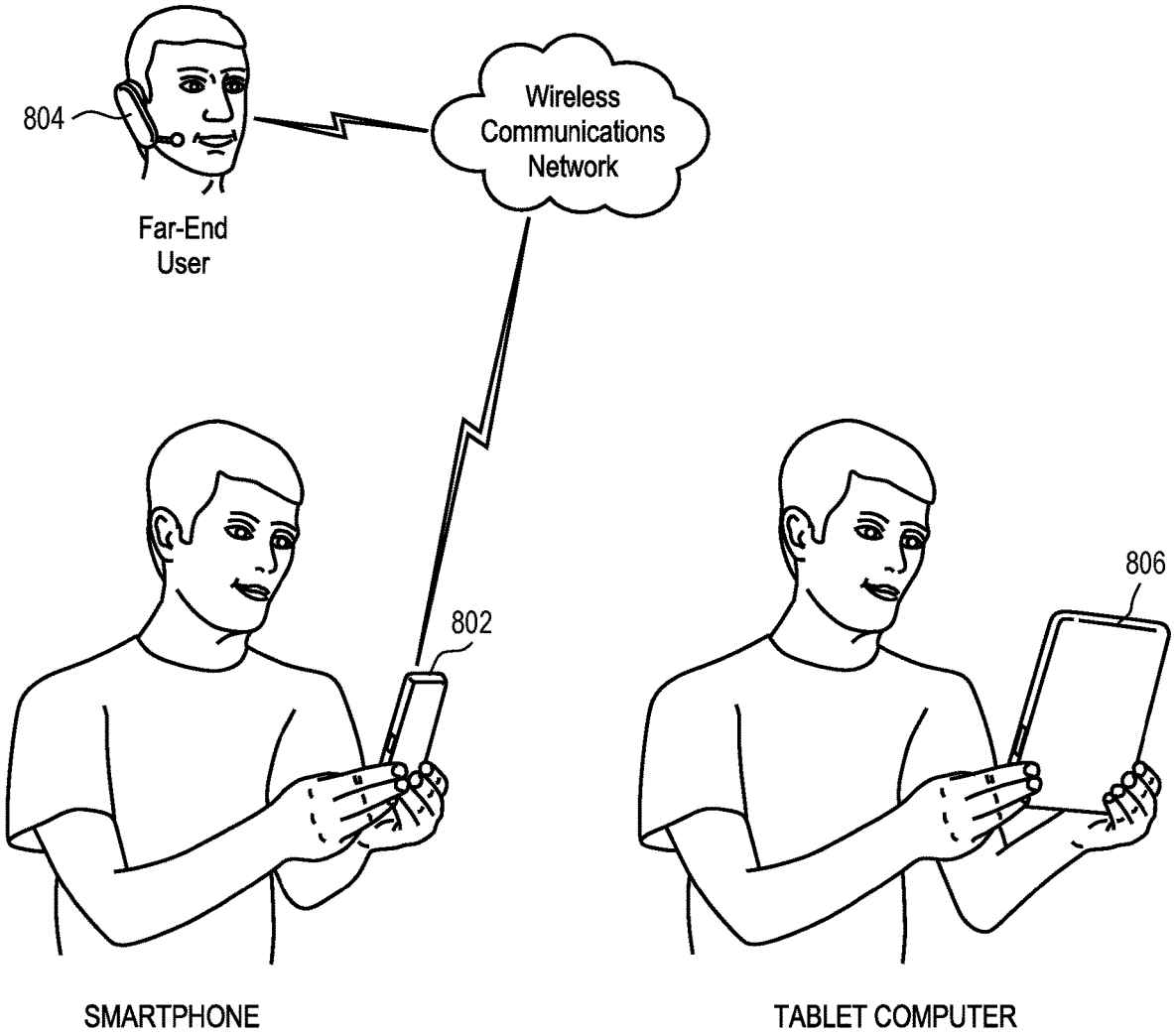
FIG. 8 illustrates a simplified schematic view of an electronic device in which a transducer assembly may be implemented.

FIG. 8 illustrates a simplified schematic perspective view of an exemplary electronic device in which a transducer assembly as described herein, may be implemented. As illustrated in FIG. 8, the transducer assembly may be integrated within a consumer electronic device 802 such as a smart phone with which a user can conduct a call with a far-end user of a communications device 804 over a wireless communications network; in another example, the transducer assembly may be integrated within the housing of a tablet computer 806. These are just two examples of where the transducer assembly described herein may be used; it is contemplated, however, that the transducer assembly may be used with any type of electronic device, for example, a home audio system, any consumer electronics device with audio capability, or an audio system in a vehicle (e.g., an automobile infotainment system.).

Figure 9:
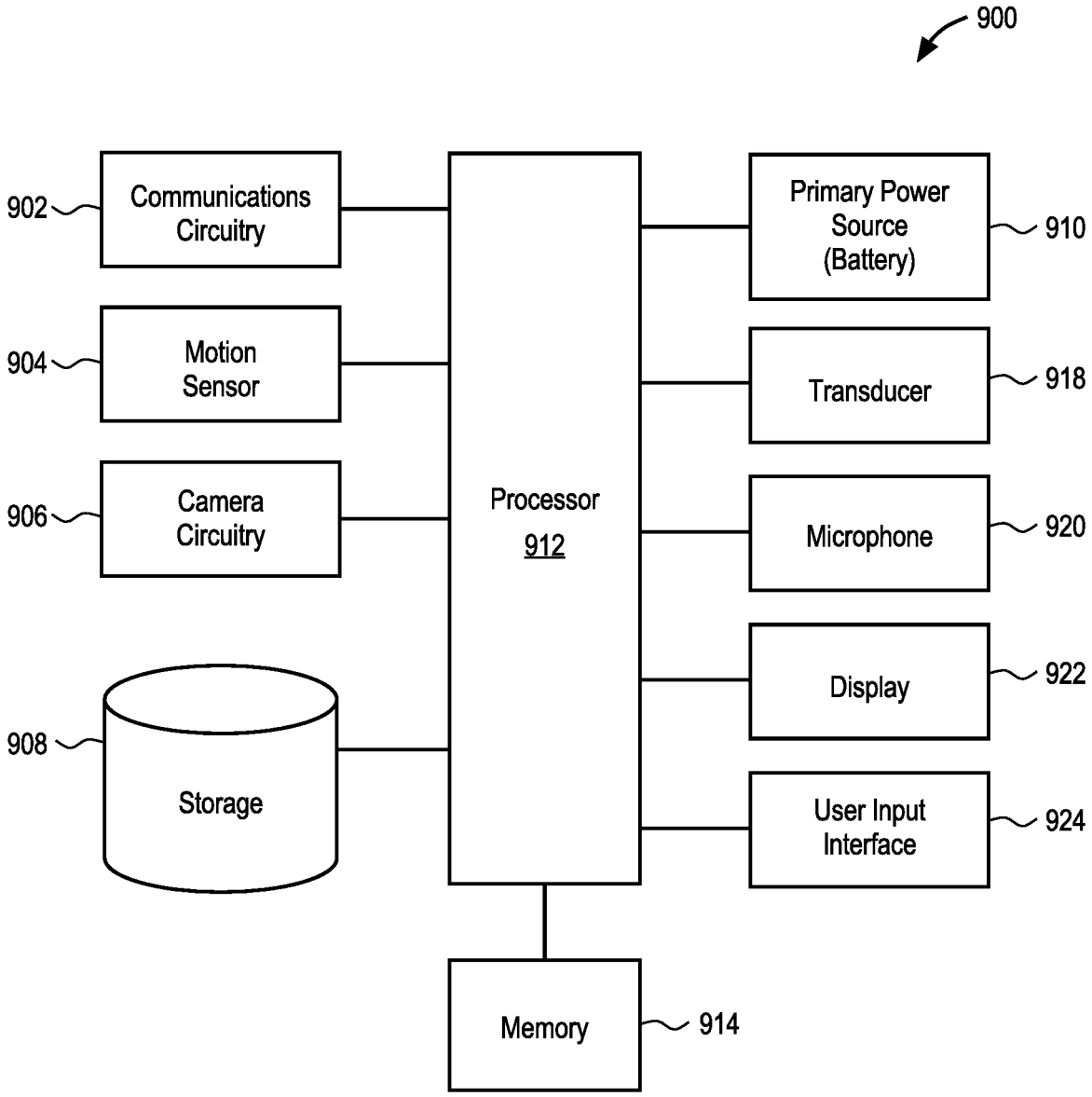
FIG. 9 illustrates a block diagram of some of the constituent components of an electronic device in which a transducer assembly may be implemented.

FIG. 9 illustrates a block diagram of some of the constituent components of an electronic device in which the transducer assembly disclosed herein may be implemented. Device 900 may be any one of several different types of consumer electronic devices, for example, any of those discussed in reference to FIG. 9.

In this aspect, electronic device 900 includes a processor 912 that interacts with camera circuitry 906, motion sensor 904, storage 908, memory 914, display 922, and user input interface 924. Main processor 912 may also interact with communications circuitry 902, primary power source 910, transducer 918 and microphone 920. Transducer 918 may be a speaker and/or the transducer assembly described herein. The various components of the electronic device 900 may be digitally interconnected and used or managed by a software stack being executed by the processor 912. Many of the components shown or described here may be implemented as one or more dedicated hardware units and/or a programmed processor (software being executed by a processor, e.g., the processor 912).

The processor 912 controls the overall operation of the device 900 by performing some or all of the operations of one or more applications or operating system programs implemented on the device 900, by executing instructions for it (software code and data) that may be found in the storage 908. The processor 912 may, for example, drive the display 922 and receive user inputs through the user input interface 924 (which may be integrated with the display 922 as part of a single, touch sensitive display panel). In addition, processor 912 may send a current or signal (e.g., audio signal) to transducer 918 to facilitate operation of transducer 918.

Storage 908 provides a relatively large amount of "permanent" data storage, using nonvolatile solid state memory (e.g., flash storage) and/or a kinetic nonvolatile storage device (e.g., rotating magnetic disk drive). Storage 908 may include both local storage and storage space on a remote server. Storage 908 may store data as well as software components that control and manage, at a higher level, the different functions of the device 900.

In addition to storage 908, there may be memory 914, also referred to as main memory or program memory, which provides relatively fast access to stored code and data that is being executed by the processor 912. Memory 914 may include solid state random access memory (RAM), e.g., static RAM or dynamic RAM. There may be one or more processors, e.g., processor 912, that run or execute various software programs, modules, or sets of instructions (e.g., applications) that, while stored permanently in the storage 908, have been transferred to the memory 914 for execution, to perform the various functions described above.

The device 900 may include communications circuitry 902. Communications circuitry 902 may include components used for wired or wireless communications, such as two-way conversations and data transfers. For example, communications circuitry 902 may include RF communications circuitry that is coupled to an antenna, so that the user of the device 900 can place or receive a call through a wireless communications network. The RF communications circuitry may include a RF transceiver and a cellular baseband processor to enable the call through a cellular network. For example, communications circuitry 902 may include Wi-Fi communications circuitry so that the user of the device 900 may place or initiate a call using voice over Internet Protocol (VOIP) connection, transfer data through a wireless local area network.

The device may include a transducer 918. Transducer 918 may be a speaker and/or a transducer assembly such as that described in reference to FIGS. 1-7. Transducer 918 may be an electric-to-acoustic transducer or sensor that converts an electrical signal input (e.g., an acoustic input) into a sound or vibration output. The circuitry of the speaker may be electrically connected to processor 912 and power source 910 to facilitate the speaker operations as previously discussed (e.g., diaphragm displacement, etc).

The device 900 may further include a motion sensor 904, also referred to as an inertial sensor, that may be used to detect movement of the device 900, camera circuitry 906 that implements the digital camera functionality of the device 900, and primary power source 910, such as a built in battery, as a primary power supply.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A transducer assembly comprising:

a stiffener plate having a first side and a second side;

a voice coil coupled to the second side of the stiffener plate;

a magnet assembly positioned along the second side of the stiffener plate, the magnet assembly operable to produce a magnetic field that causes a movement of the magnet assembly relative to the voice coil; and a leaf spring suspending the magnet assembly from the stiffener plate such that the movement of the magnet assembly drives a movement of the stiffener plate toward or away from the magnet assembly, the leaf spring having a first extension member attached to the stiffener plate, a second extension member attached to the magnet assembly, and an expandable joint positioned around a perimeter of the magnet assembly to allow the first extension member and the second extension member to move toward or away from one another depending on the movement of the magnet assembly.

2. The transducer assembly of claim 1 wherein the first extension member is attached to the second side of the stiffener plate and the second extension member is attached to a bottom side of the magnet assembly, wherein the bottom side faces away from second side of the stiffener plate.

3. The transducer assembly of claim 1 wherein the magnet assembly comprises a polygon shape having a number of sides, and the leaf spring is positioned along one of the sides.

4. The transducer assembly of claim 1 wherein the leaf spring is one of a plurality of leaf springs symmetrically arranged around a perimeter of the magnet assembly.

5. The transducer assembly of claim 1 wherein the leaf spring is a first leaf spring, the assembly further comprises a second leaf spring, and wherein the first leaf spring is positioned around the perimeter of the magnet assembly and the second leaf spring is positioned within a center opening of the magnet assembly.

6. The transducer assembly of claim 5 wherein the second leaf spring is at an angle of from 35 degrees to 55 degrees relative to the first leaf spring.

7. The transducer assembly of claim 1 further comprising an actuating surface coupled to the first side of the stiffener plate.

8. The transducer assembly of claim 7 wherein the actuating surface comprises a wall of a device within which the transducer assembly is integrated.

9. A transducer assembly comprising:

a stiffener plate having a first side and a second side;

a voice coil coupled to the second side of the stiffener plate;

a magnet assembly positioned along the second side of the stiffener plate, the magnet assembly operable to produce a magnetic field that causes a movement of the magnet assembly relative to the voice coil; and a plurality of springs coupling the magnet assembly to the stiffener plate, wherein each spring of the plurality of springs comprises a first extension member attached to the second side of the stiffener plate and a second extension member attached to a bottom side of the magnet assembly, and the first extension member and the second extension member move away from one another when the magnet assembly moves away from the stiffener plate and the first extension member and the second extension member move toward one another when the magnet assembly moves toward the stiffener plate.

10. The transducer assembly of claim 9 wherein the plurality of springs are symmetrically arranged around the magnet assembly.

11. The transducer assembly of claim 9 wherein the plurality of springs comprise a first set of springs and a second set of springs, wherein the first set of springs are arranged around a perimeter of the magnet assembly, and the second set of springs are arranged around a center opening of the magnet assembly.

12. The transducer assembly of claim 11 wherein the perimeter of the magnet assembly is defined by sides of the magnet assembly connected to form a polygon shape and the second set of springs are positioned along each diagonal axis of the polygon shape.

13. The transducer assembly of claim 11 wherein the center opening of the magnet assembly comprises a polygon shape.

14. The transducer assembly of claim 11 wherein each spring of the second set of springs is rotated from 35 degrees to 45 degrees relative to at least one spring of the first set of springs.

15. The transducer assembly of claim 9 wherein the bottom side of the magnet assembly comprises a bottom recessed region within which the second extension member is positioned, and a top side of the magnet assembly comprises a top recessed region aligned with the first extension member.

16. A transducer assembly comprising:

a stiffener plate having a first side operable to be connected to an actuating surface and a second side;

a voice coil coupled to the second side of the stiffener plate;

a magnet assembly positioned along the second side of the stiffener plate, the magnet assembly operable to produce a magnetic field that causes a movement of the magnet assembly relative to the voice coil; and a plurality of suspension members coupling the magnet assembly to the stiffener plate and the movement of the magnet assembly drives a movement of the stiffener plate, wherein the plurality of suspension members comprise a first set of suspension members and a second set of suspension members, wherein the first set of suspension members are arranged around a perimeter of the magnet assembly, and the second set of suspension members are arranged around a center opening of the magnet assembly.

17. The transducer assembly of claim 16 wherein the plurality of suspension members comprise leaf springs having a first end coupled to the second side of the stiffener plate and a second end coupled to a bottom side of the magnet assembly.

18. The transducer assembly of claim 16 wherein the first set of suspension members are equally arranged around the perimeter of the magnet assembly and the second set of suspension members are equally arranged around the center opening of the magnet assembly.

19. The transducer assembly of claim 18 wherein at least one of the suspension members arranged around the center opening is rotated at least 35 degrees relative to at least one of the suspension members arranged around the perimeter.

20. The transducer assembly of claim 18 wherein when the first side is connected to the actuating surface, and the movement of the stiffener plate causes a vibration of the actuating surface.

* * * * *